US010813814B2

(12) United States Patent
Wassmer et al.

(10) Patent No.: US 10,813,814 B2
(45) Date of Patent: Oct. 27, 2020

(54) HOSPITAL ROOM HEADBOARD ASSEMBLY AND METHOD

(71) Applicant: ARTISAN DISPLAY INC., Redhill, PA (US)

(72) Inventors: John M. Wassmer, Richlandtown, PA (US); Herbert T. Wassmer, Quakertown, PA (US); Dianne M. Wassmer, Richlandtown, PA (US); John M. Wassmer, Jr., Pottstown, PA (US)

(73) Assignee: ARTISAN DISPLAY INC., Redhill, PA (US)

( * ) Notice: Subject to any disclaimer, the term of this patent is extended or adjusted under 35 U.S.C. 154(b) by 341 days.

(21) Appl. No.: 16/034,568

(22) Filed: Jul. 13, 2018

(65) Prior Publication Data

US 2019/0015280 A1 Jan. 17, 2019

Related U.S. Application Data

(60) Provisional application No. 62/532,153, filed on Jul. 13, 2017.

(51) Int. Cl.
*A61G 12/00* (2006.01)

(52) U.S. Cl.
CPC ..... *A61G 12/002* (2013.01)

(58) Field of Classification Search
CPC ..... A61G 12/002
See application file for complete search history.

(56) References Cited

U.S. PATENT DOCUMENTS

| | | | | |
|---|---|---|---|---|
| 4,753,055 | A * | 6/1988 | Durham, Jr. | A61G 12/005 174/70 R |
| 5,687,717 | A * | 11/1997 | Halpern | A61B 5/0205 600/300 |
| 9,373,943 | B1 * | 6/2016 | Tannenbaum | H02G 3/0437 |
| 9,441,357 | B1 * | 9/2016 | Vafaee | E04B 1/34869 |
| 2005/0246982 | A1 * | 11/2005 | MacMillan | H02G 9/10 52/220.8 |
| 2011/0178609 | A1 * | 7/2011 | Parker | G05B 15/02 700/12 |
| 2013/0322012 | A1 * | 12/2013 | Dunwoody | G06F 1/20 361/679.53 |

(Continued)

*Primary Examiner* — Joshua K Ihezie
(74) *Attorney, Agent, or Firm* — Volpe Koenig

(57) ABSTRACT

A hospital room headboard assembly and methods are provided that includes an open face rigid box structure within which a plurality of separate plumbing systems are installed. A plurality of separate electrical power circuits are also installed within the rigid box structure. At least one separate electrical and/or optical data circuit is also installed within the rigid box structure. Purity and integrity certification of each plumbing system is preferably conducted before installing the rigid box structure to qualify each plumbing system as a certified system. This enables the rigid box structure to be installed having the certified plumbing systems and electrical and data circuits installed therein in a hospital room as a headboard assembly. Pre-installation can also include conducting certification of each electrical power circuit and each data circuit to qualify each as a certified circuit in advance of installing the rigid box structure in a hospital room.

18 Claims, 7 Drawing Sheets

(56) References Cited

U.S. PATENT DOCUMENTS

| | | | | |
|---|---|---|---|---|
| 2015/0057765 | A1* | 2/2015 | Parker | G05B 15/02 700/12 |
| 2017/0321415 | A1* | 11/2017 | Vafaee | E04B 1/5831 |
| 2017/0337797 | A1* | 11/2017 | McClellan | A61G 12/008 |
| 2018/0093900 | A1* | 4/2018 | Dickson | E03C 1/021 |
| 2019/0093356 | A1* | 3/2019 | Collins | E04C 2/52 |
| 2019/0301648 | A1* | 10/2019 | Leckner | F16L 37/084 |
| 2020/0052924 | A1* | 2/2020 | Gimeno | G06F 3/0482 |

* cited by examiner

HOSPITAL ROOM HEADBOARD ASSEMBLY AND METHOD

CROSS REFERENCE TO RELATED APPLICATION

The present application is a non-provisional of Provisional Application No. 62/532,153 filed Jul. 13, 2017 which is incorporated herein by reference as if fully set forth.

FIELD OF INVENTION

The present invention generally relates to facilitating the provision of utilities for hospital rooms.

BACKGROUND

Generally, hospital rooms require multiple electrical and fluid services to be available for patient care and/or monitoring. Outlets for utilities such as oxygen, vacuum, electrical power, data services and emergency power are typically desired and may be provided at the head of a patient bed. It is known in the art to provide plumbing and wiring internal to a studded wall construction. However, such construction when including the provision of multiple gas ports and electric outlets is time consuming and requires in-situ testing of each outlet in the hospital room.

SUMMARY

A hospital room headboard assembly and methods are provided. The assembly and method provide multiple utility services for a hospital room or the like.

An open face rigid box structure is provided within which a plurality of separate plumbing systems are installed. Each plumbing system preferably has an inlet port for connection with a desired fluid supply and a plurality of outlet ports positioned on the open face of the rigid box structure at predetermined locations for providing access to fluid supplied via the inlet port.

A plurality of separate electrical power circuits are also installed within the rigid box structure. Each circuit has a master lead for coupling with a desired source and a plurality of outlets positioned on the open face of the rigid box structure at predetermined locations for providing access to electrical power via the master leads.

At least one separate electrical and/or optical data circuit is also installed within the rigid box structure. Each data circuit may have a primary connector for coupling with a data line or device and one or more of user connectors positioned on the open face of the rigid box structure at predetermined locations for providing communication of electrical or optical data signals via the primary connector.

Purity and integrity certification of each plumbing system is preferably conducted before installing the rigid box structure to qualify each plumbing system as a certified system. This enables the rigid box structure to be installed having the certified plumbing systems and electrical and data circuits installed therein in a hospital room as a headboard assembly.

Pre-installation can also include conducting certification of each electrical power circuit to qualify each electrical power circuit as a certified circuit in advance of installing the rigid box structure. Pre-installation can also include conducting integrity certification of each data circuit to qualify each data circuit as a certified circuit in advance of installing the rigid box structure.

In one embodiment, during hospital room installation, a covering for the open face of the rigid box structure is installed along with outlet port covers and user connector and outlet covers after securing the rigid box assembly in place.

Preferably, the separate plumbing systems include at least one system for oxygen, one system for vacuum and one system for medical air. Preferably, the separate electrical circuits include at least one circuit for normal power and one circuit for emergency power.

In constructing the headboard assembly, a template of predetermined port, connector and outlet positions can be provided and used to assure proper positioning of the outlet ports, user connectors and electrical outlets. Preferably, the rigid box structure has a depth of between 3-4 inches and the outlet ports, user connectors and electrical outlets are mounted on horizontal cross members on the open face of the rigid box structure.

The headboard assembly may also include an extension projecting from the open face side of the rigid box structure for lighting or other uses. Preferably, the projecting extension extends from the top of the rigid box structure and has lighting fixtures installed therein.

BRIEF DESCRIPTION OF THE DRAWING(S)

DETAILED DESCRIPTION OF THE PREFERRED EMBODIMENT(S)

Figure 1B:
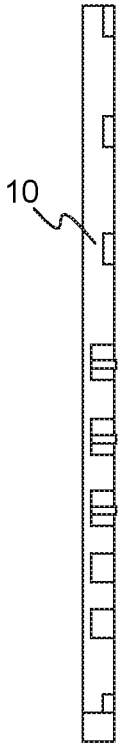
FIG. 1B is a side view of the headboard assembly of FIG. 1A.
Figure 1A:
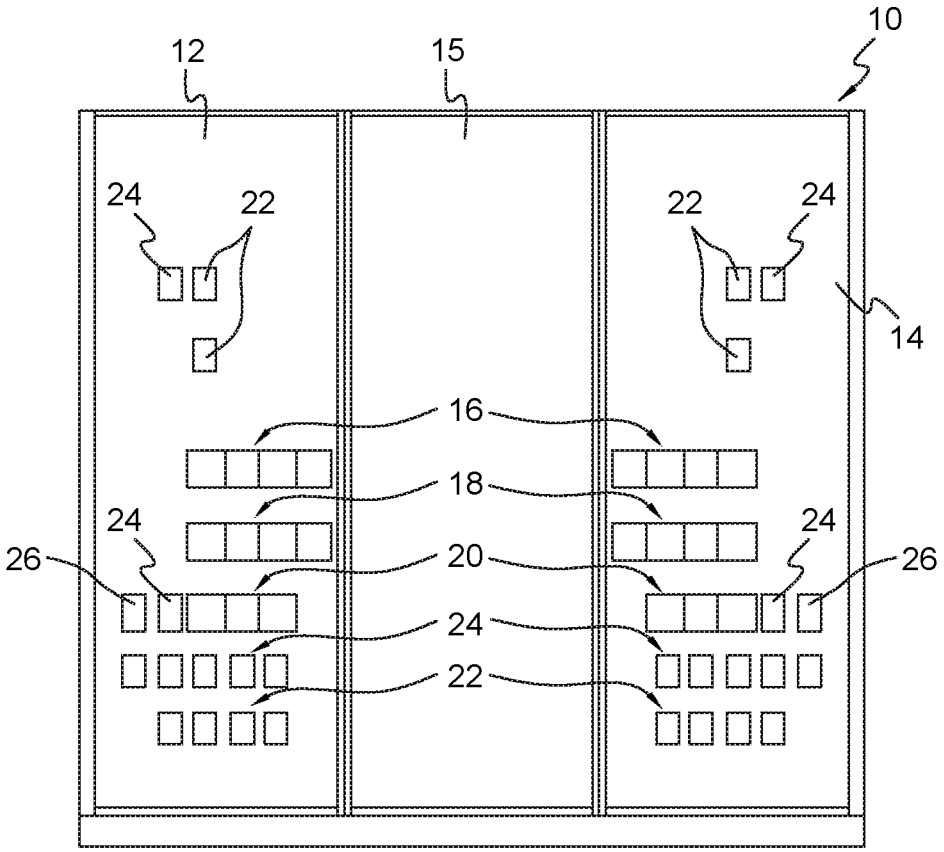
FIG. 1A is a front view of a headboard assembly made in accordance with the teachings of the present invention.

With reference to the drawings, an example, hospital room headboard assembly is disclosed. With reference to FIGS. 1 and 2, an example hospital room headboard assembly having an open box structure 10 is shown having a variety of outlet ports and user connectors and outlets that provide access to multiple utility services when installed in a hospital room or the like.

The example headboard assembly box structure 10, includes a left section 12 and a right section 14 that each have a plurality of plumbing systems that provide a plurality of oxygen ports 16, a plurality of medical air ports 18, and a plurality of vacuum ports 20. Each section 12, 14 also includes circuitry for a plurality of standard electrical outlets 22, a plurality of emergency electrical outlets 24, and at least one data port 26.

A middle section 15 is provided without ports for providing space where a hospital bed can be positioned with its head towards the headboard assembly. In the example, the sections are each three feet wide and eight feet high so that the assembly is nine feet wide and eight feet high. The headboard assembly box structure 10 preferably has a depth of between 3-4 inches so that it presents a low-profile which can be attached to or embedded in an existing wall. The box structure 10 of which the headboard assembly is constructed preferably has a steel frame that enables it to serve as a wall section on its own.

As discussed below, the headboard assembly is prefabricated as an open face box structure 10 having the plumbing systems and various circuits installed therein. The plumbing systems are preferably tested and certified for purity and integrity before being provided for installation in a hospital room. The certification standards may be regionally, nationally, or internationally maintained and recognized, and by non-limiting way of example may include those of ASSE International, ASPE CPD, NSF/ANSI 14, IAPMO, or QAI.

The electrical power and data circuits are also preferably tested and may also be certified in advance of installation. Electrical and data certification standards employed may include by non-limiting way example those of OSHA, IEECE CB Scheme, MAS, NTS-CAF, NTS-SIR, or FCC/TCB.

Figure 1C:
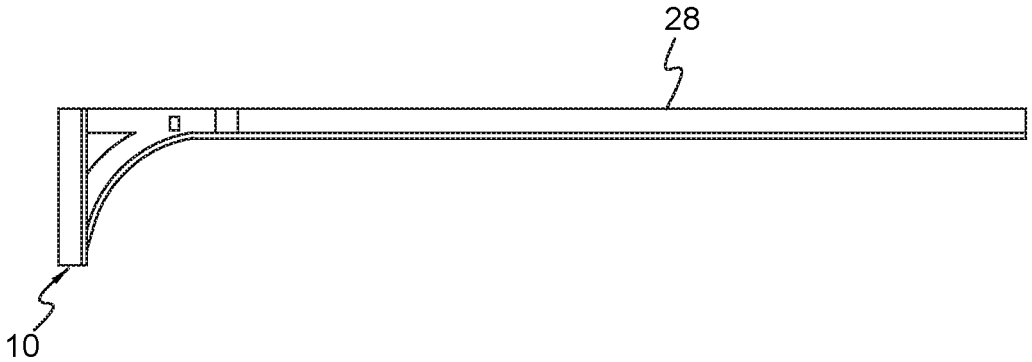
FIG. 1C is a side view of an extension projection for lighting or other use, projecting from the front of the headboard assembly of FIG. 1A.
Figure 2:
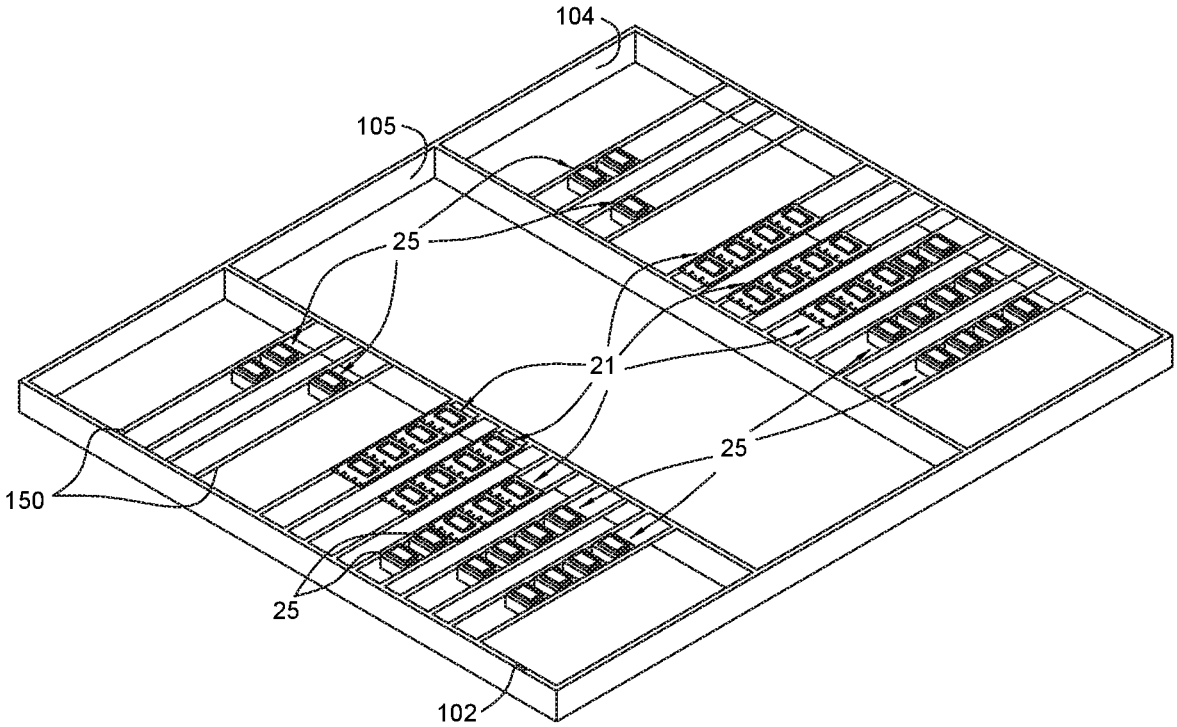
FIG. 2 is a perspective view of a headboard assembly made in accordance with the teachings of the present invention during manufacture, less plumbing and circuitry.

With reference to FIG. 1C, an extension 28 can be mounted to project from the open face side of the rigid box structure of the headboard assembly 10 for lighting or other uses. Preferably, the projecting extension 28 extends from the top of the rigid box structure and has lighting fixtures installed therein.

With reference to FIGS. 3-6, the construction of the headboard assembly 10 is illustrated. In the example, a rigid open faced steel box structure 10 of the headboard assembly includes a left box section 102, a right box section 104 and a central box section 105.

Within each of the left and right box sections 102, 104, separate plumbing systems are provided for oxygen 106, medical air 108, and vacuum 110. In the example, each plumbing system has an inlet port extending from the top of the box structure 10 for connection with a respective fluid supply (vacuum being a negative fluid supply in this context). Each plumbing system 106, 108, 110 has a branched pipe configuration leading to a plurality of fluid outlet ports 16, 18, 20 positioned on the open face of the rigid box structure 10 at predetermined location.

Figure 3:
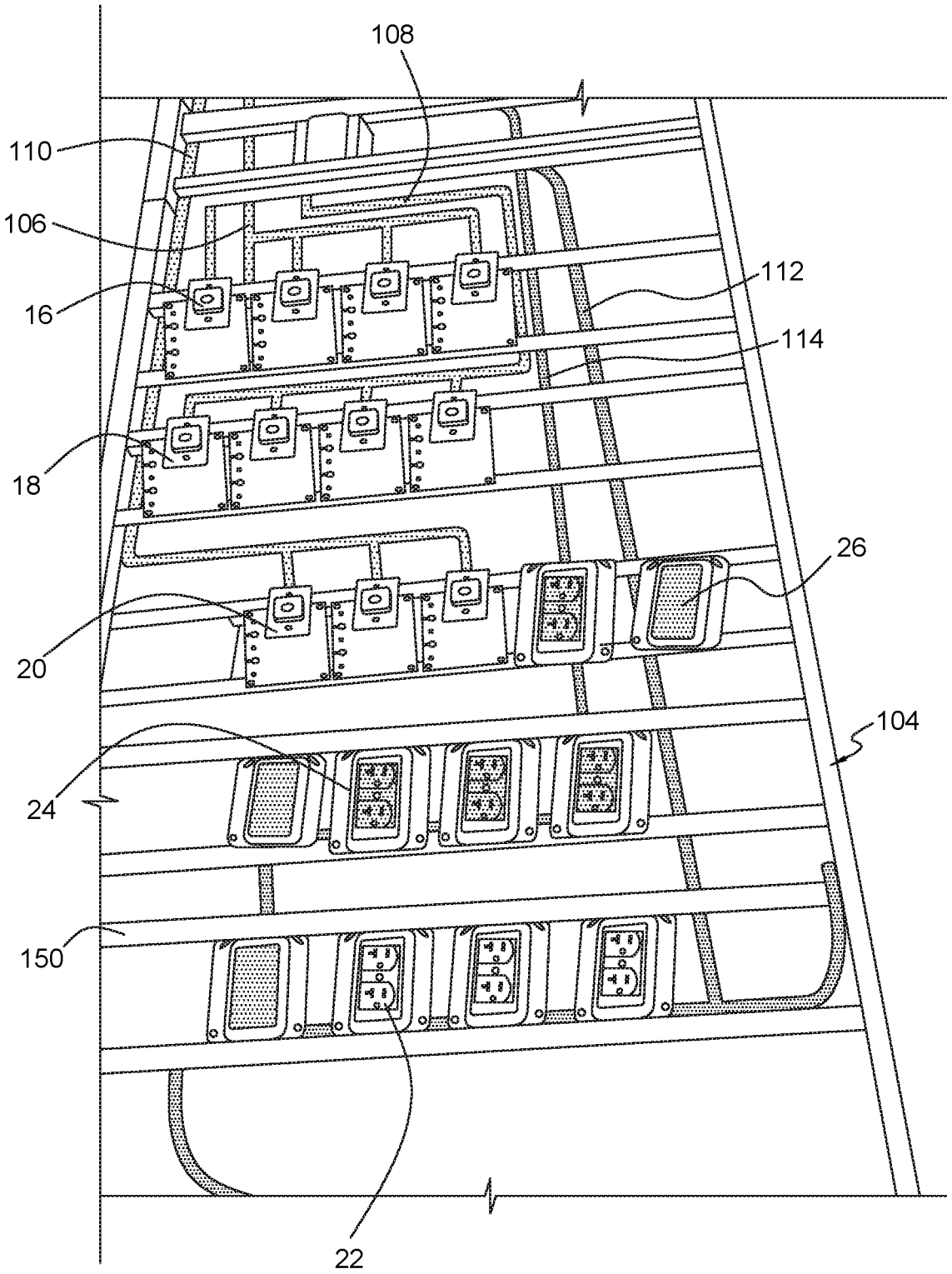
FIG. 3 is a view of the right side of the headboard assembly of FIG. 2, with example schematic plumbing and circuitry.
Figure 4:
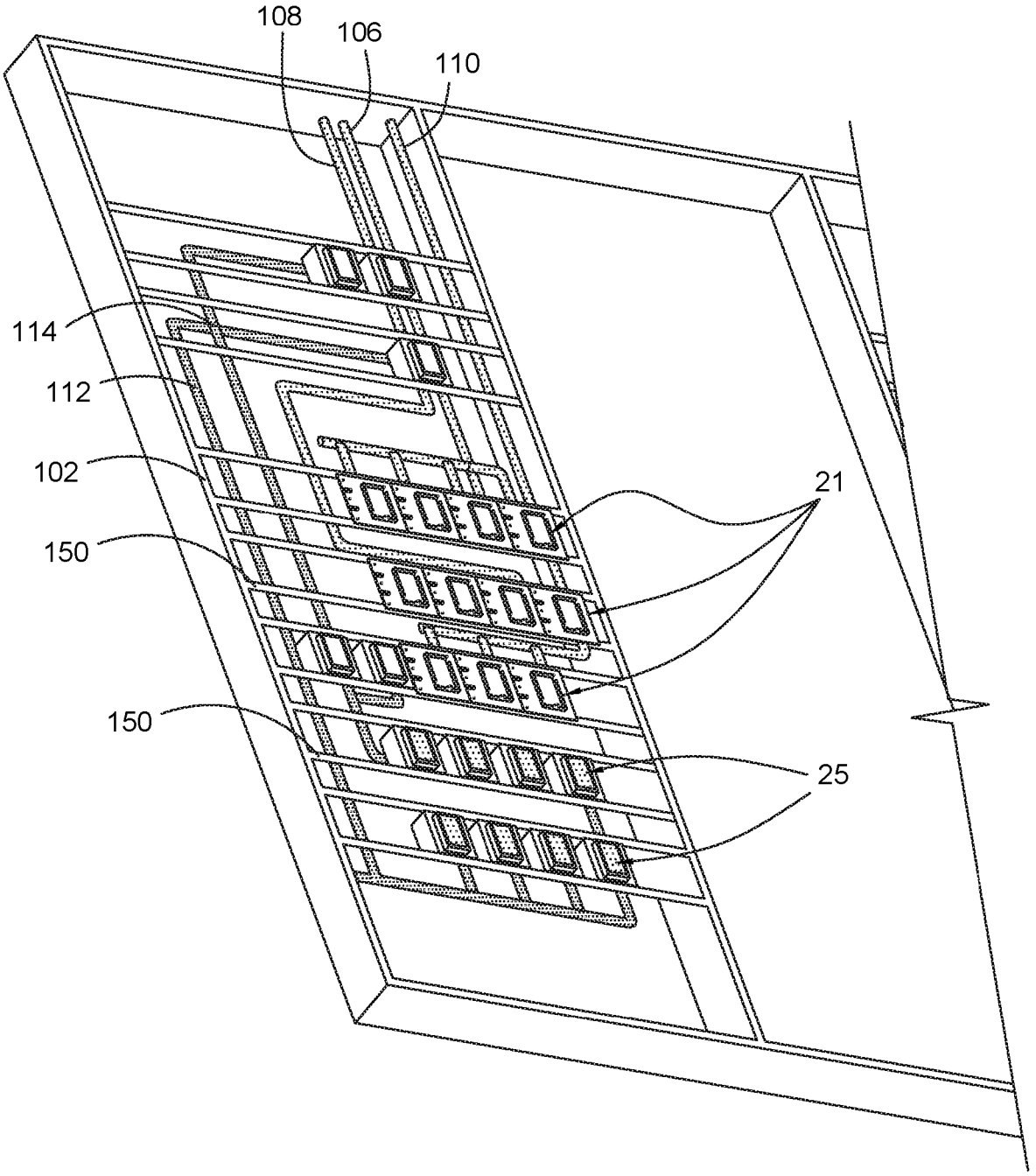
FIG. 4 is a view of the left side of the headboard assembly of FIG. 2, with example schematic plumbing and circuitry.

In the example, outlet port coupling mounting boxes 21 are provided at each pipe branch end for facilitating installation of the fluid outlet port 16, 18, 20 at each pipe branch end at a desired pre-determined location on the open face of the open face box structure 102, 104. FIG. 4 shows the fluid outlet port coupling mounting boxes 21 for the plumbing systems; FIG. 3 shows examples of several of the fluid outlet ports 16, 18, 20 that are to be installed via the respective mounting boxes 21.

Within each of the left and right box sections 102, 104, separate electrical power and data circuits are provided for normal electrical power, emergency power, and data. In the example, each power circuit has a master connector, which may be wire leads, that extends from the box structure for coupling with a desired source.

Each power circuit has a branched conduit configuration 112, 114 leading to a plurality of outlet boxes 25 positioned on the open face of the rigid box structure at predetermined locations. In the example, outlet boxes are provided at each pipe branch end for facilitating the electrical power outlet installation at each conduit branch end at a desired predetermined location on the open face of the open face box structure 102, 104. FIG. 4 shows the outlet boxes 25 for the electrical power circuits. FIG. 3 shows examples of several of the electrical outlets 22, 24 that are to be installed in the respective outlet boxes 25. The branched conduit configuration 112 is coupled to the outlet boxes 25 for the electrical outlets 22 for normal electrical power and the branched conduit configuration 114 is coupled to the outlet boxes 25 for the electrical outlets 24 for emergency electrical power.

In the example, a data circuit is configured to carry electrical and/or optical data signals and preferably has a master connector that extends from the box structure for coupling with a desired device. The data circuit may have a single or branched conduit configuration leading to one or a plurality of outlet boxes positioned on the open face of the rigid box structure at predetermined locations. In the example, one connector box is provided on each of the left and right sections 102, 104 of the box structure 10 for facilitating the installation of a data coupling 26 at a desired pre-determined location on the open face of the open face box structure 102, 104.

Figure 6:
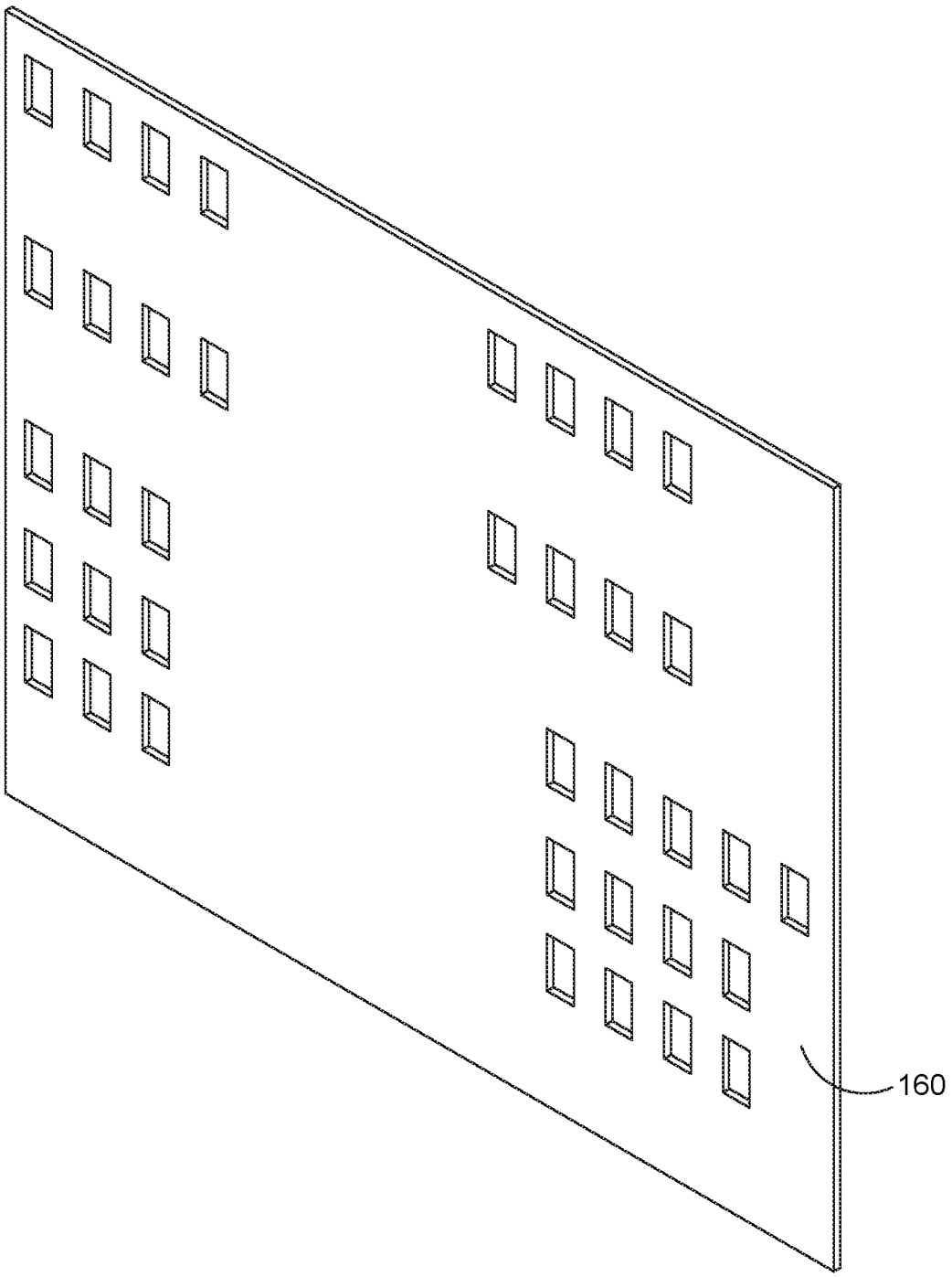
FIG. 6 is a view of an example positioning template in accordance with the teachings of the present invention.
Figure 7:
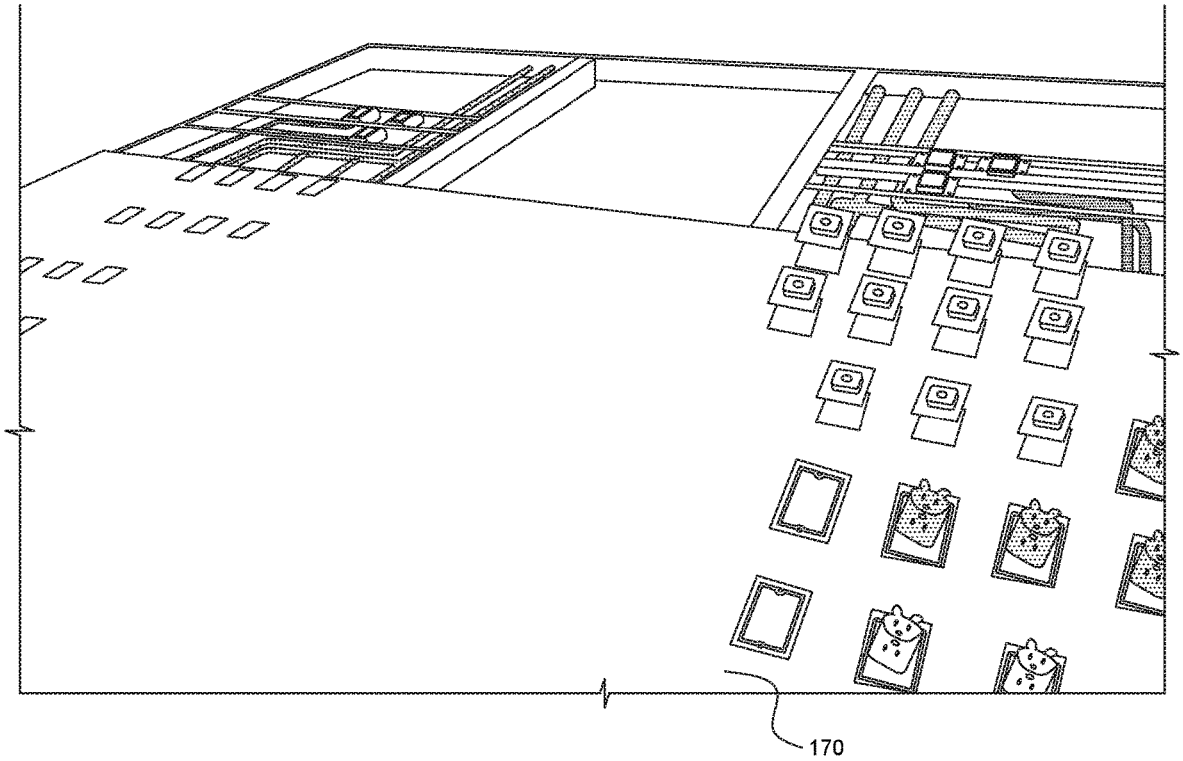
FIG. 7 is a view of a positioning template similar to FIG. 6 being used in connection with the headboard assembly of FIG. 2 during manufacture.

Exemplified in FIG. 4, to facilitate precise positioning of the plumbing outlets, 16, 18, 20, the electrical outlets 22, 24, and data ports 26, cross members 150 are provided across the open face of the box sections 102, 104, to which the mounting boxes for the respective utilities are secured. With reference to FIG. 6, a positioning template 160 is shown that has openings for the arrays of predetermined locations for where the plumbing outlets, 16, 18, 20, the electrical outlets 22, 24, and data ports 26 are to be positioned. The template is used to assure proper location of the respective mounting boxes. FIG. 7 shows a similar positioning template as it would be used to aid in positioning of the mounting boxes during manufacture of the open faced box structure 10.

Example templates 160 and 170 can also be used to construct covering panels for the open face box structure sections 102, 104 with appropriate openings to permit access to the plumbing outlets, 16, 18, 20, the electrical outlets 22, 24, and data ports 26. When the headboard assembly 10 is installed in a hospital room, the pre-fabricated, pre-tested, pre-certified open box structure assembly can be secured as a unit in place and then the covering panels installed over the open face. However, the covering panels may be pre-installed in the assembly 10 and the entire unit installed at a desired location with appropriate anchoring.

Figure 5:
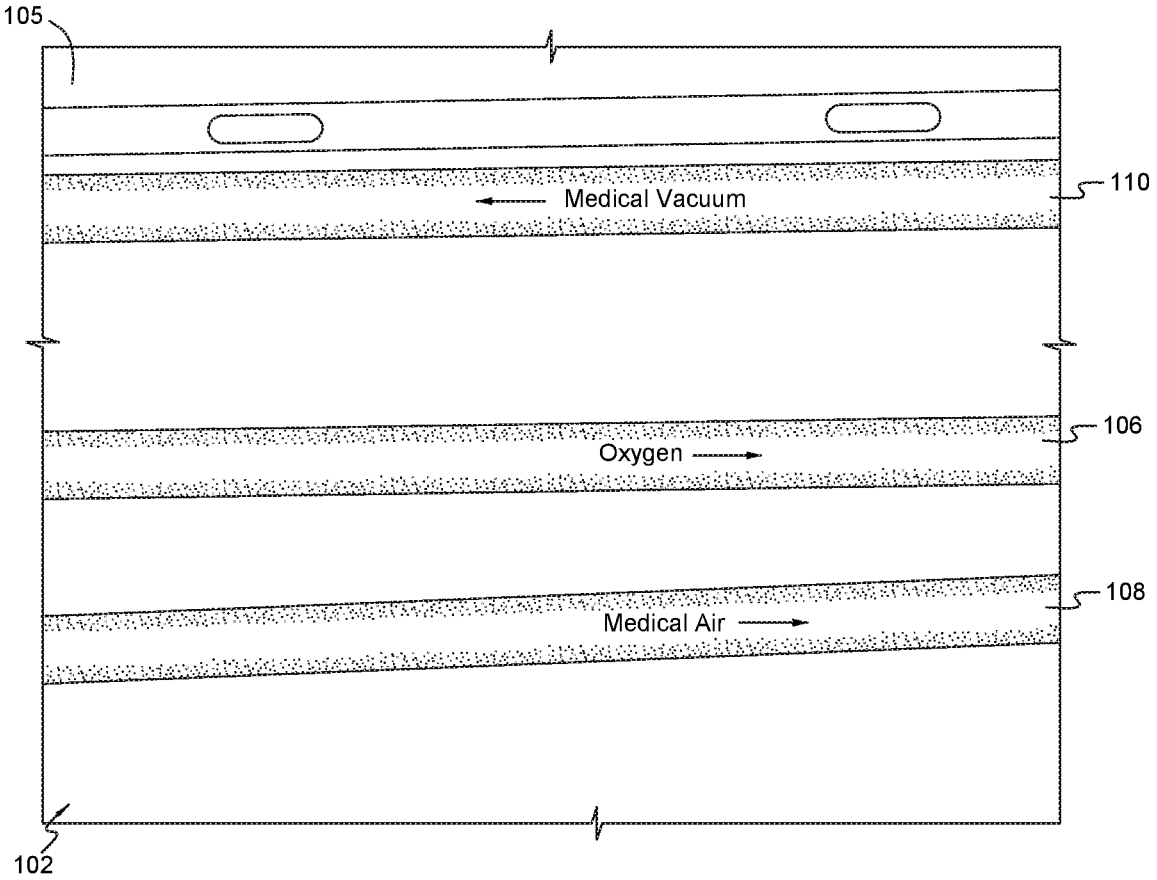
FIG. 5 is a view of a portion of the plumbing systems of the headboard assembly of FIG. 4.

In one example, the open face rigid box structure 10 is provided in which the plurality of separate plumbing systems 106, 108, 110 are installed, as seem in FIGS. 3-5. Each plumbing system preferably has an inlet port for connection with a desired fluid supply and a plurality of fluid outlet ports 16, 18, 20 positioned on the open face of the rigid box structure at predetermined locations for providing access to fluid supplied via the inlet port.

Separate normal and emergency electrical power circuits are also installed within branched conduit configurations 112, 114 mounted in the rigid box structure 10. Each circuit has a master lead for coupling with a desired source and a respective plurality of electrical outlets 22, 24 positioned on the open face of the rigid box structure 10 at predetermined locations for providing access to electrical power via the master leads.

In the disclosed embodiment, an electrical and/or optical data circuit is also installed within the rigid box structure 10. The data circuit has a primary connector for coupling with a data line or device and a user connector 26 positioned on each of the left and right sections 102, 104 of the open face of the rigid box structure 10 at predetermined locations for providing communication of electrical or optical data signals via the primary connector, as in FIG. 3.

Purity and integrity certification of each plumbing system is preferably conducted before installing the rigid box structure 10 to qualify each plumbing system 106, 108, 110 as a certified system. This enables the rigid box structure to be installed having certified plumbing systems along with the electrical power and data circuits installed therein in a hospital room as a headboard assembly.

Pre-installation can also include conducting certification of each electrical power circuit to qualify each electrical power circuit as a certified circuit in advance of installing the rigid box structure in a hospital room as a headboard assembly. Pre-installation can also include conducting integrity certification of each data circuit to qualify each data circuit as a certified circuit in advance of installing the rigid box structure in a hospital room as a headboard assembly.

In one embodiment, during hospital room installation, a covering for the open face of the rigid box structure is installed along with fluid outlet port covers, electrical power outlet covers/plates and user data connector covers after securing the rigid box assembly in place.

The headboard assembly may also have the extension 28 projecting from the open face side of the rigid box structure for lighting or other uses pre-installed before the assembly is installed in a hospital room.

Although the invention was disclosed with respect to a particular example, the example is non-limiting. The number and type of plumbing systems, electrical circuits and data circuits may vary in accordance with the needs of a particular installation site. Although the disclosed embodiment has relatively symmetrical left and right sections this is non-limiting and, for example, one or more such sections may be provided to serve one or more hospital beds.

What is claimed is:

1. A method of providing multiple utility services for a hospital room comprising:

providing an open face rigid box structure;

installing a plurality of separate plumbing systems within the rigid box structure, each plumbing system having an inlet port for connection with a desired fluid supply and a plurality of outlet ports positioned on the open face of the rigid box structure at predetermined locations for providing access to fluid supplied via the inlet port;

installing a plurality of separate electrical power circuits within the rigid box structure, each electrical power circuit having a master lead for coupling with a desired power source and a plurality of outlets positioned on the open face of the rigid box structure at predetermined locations for providing access to electrical power via the master lead;

installing at least one data circuit within the rigid box structure, the data circuit having a primary connector for coupling with a data line or device and at least one user connector positioned on the open face of the rigid box structure at a predetermined location for providing communication of data via the primary connector;

conducting purity and integrity certification of each plumbing system to qualify each plumbing system as a certified plumbing system; and thereafter installing the rigid box structure having the certified plumbing systems and electrical power and data circuits installed therein in a hospital room as a headboard assembly.

2. The method according to claim 1 wherein the separate plumbing systems include at least one system for oxygen, one system for vacuum and one system for medical air.

3. The method according to claim 2 further including conducting integrity certification of each electrical power circuit to qualify each electrical power circuit as a certified electrical circuit in advance of installing the rigid box structure.

4. The method according to claim 3 wherein the separate power circuits include at least one circuit for normal power and one circuit for emergency power.

5. The method according to claim 4 further including conducting integrity certification of each data circuit to qualify each data circuit as a certified data circuit in advance of installing the rigid box structure.

6. The method according to claim 1 further including providing a template of predetermined port, connector and outlet positions and using the template to assure proper positioning of the outlet ports and user connectors and outlets.

7. The method according to claim 6 wherein the installation of the rigid box structure includes providing a covering for the open face of the rigid box structure having outlet port covers and user connector and outlet covers, the positioning of which is based upon the template.

8. The method according to claim 1 wherein the rigid box structure is constructed to have a depth of between 3-4 inches and the outlet ports and user connectors and outlets are mounted on horizontal cross members on the open face of the rigid box structure.

9. The method according to claim 1 wherein the installation of the rigid box structure further includes providing an extension projecting from the top of the rigid box structure having lighting fixtures and requisite circuitry installed therein.

10. The method according to claim 1 further including conducting certification of each electrical power circuit to qualify each electrical power circuit as a certified circuit in advance of installing the rigid box structure and conducting integrity certification of each data circuit to qualify each data circuit as a certified circuit in advance of installing the rigid box structure.

11. A hospital room headboard assembly comprising:

an open face rigid box structure;

a plurality of separate plumbing systems installed within the rigid box structure, each plumbing system having an inlet port for connection with a desired fluid supply and a plurality of outlet ports positioned on the open face of the rigid box structure at predetermined locations for providing access to fluid supplied via the inlet port;

a plurality of separate electrical power circuits installed within the rigid box structure, each power circuit having a master lead for coupling with a desired power source and a plurality of outlets positioned on the open face of the rigid box structure at predetermined locations for providing access to electrical power via the master lead; and at least one data circuit installed within the rigid box structure, the data circuit having a primary connector for coupling with a data line or a desired device and at least one user connector positioned on the open face of the rigid box structure at a predetermined location for providing communication of data signals via the primary connector;

wherein purity and integrity certification of each plumbing system is conducted before installing the rigid box structure in a hospital room as a headboard assembly.

12. The hospital room headboard assembly according to claim 11 wherein the separate plumbing systems include at least one system for oxygen, one system for vacuum and one system for medical air.

13. The hospital room headboard assembly according to claim 11 wherein the separate electrical power circuits include at least one circuit for normal power and one circuit for emergency power.

14. The hospital room headboard assembly according to claim 11 wherein the rigid box structure includes left and right sections that each have a plurality of plumbing systems including at least one system for oxygen, one system for vacuum and one system for medical air, and a plurality of circuits including at least one circuit for normal power, one circuit for emergency power and one data circuit.

15. The hospital room headboard assembly according to claim 12 wherein the rigid box structure further includes a middle section with dimensions optimized to facilitate placement of a head of a hospital bed without inhibiting access to the ports and outlets on either the left or right sections.

16. The hospital room headboard assembly according to claim 15 wherein the rigid box structure has a depth of between 3-4 inches and the outlet ports and user connectors and outlets are mounted on horizontal cross members on the open face of the rigid box structure.

17. The hospital room headboard assembly according to claim 16 wherein the rigid box structure is constructed of a steel frame.

18. The hospital room headboard assembly according to claim 17 including an extension projecting from the top of the rigid box structure having lighting fixtures installed therein.

* * * * *